United States Patent [19]

Perrault

[11] 4,010,662

[45] Mar. 8, 1977

[54] FLEXIBLE STRAP WRENCH

[75] Inventor: Robert Thomas Perrault, Rockaway, N.J.

[73] Assignee: R. Thomas Perrault, Rockaway, N.J.

[22] Filed: Aug. 28, 1975

[21] Appl. No.: 608,781

[52] U.S. Cl. ..... 81/64

[51] Int. Cl.[2] ..... B25B 13/52

[58] Field of Search ..... 81/64, 3.43; 294/74, 294/31.2

[56] References Cited

UNITED STATES PATENTS

| | | | |
|---|---|---|---|
| 1,953,238 | 4/1934 | Kosanovich | 81/3.43 |
| 3,084,573 | 4/1963 | Lipski | 81/3.43 |
| 3,211,489 | 10/1965 | Gill | 294/74 |
| 3,756,097 | 9/1973 | Whitlock | 81/15.8 |

*Primary Examiner*—James L. Jones, Jr.

[57] ABSTRACT

A flexible strap wrench that is especially adapted to aid in the insertion of one length of pipe into another such as where a threaded fitting is joined.

8 Claims, 4 Drawing Figures

FIG. 1
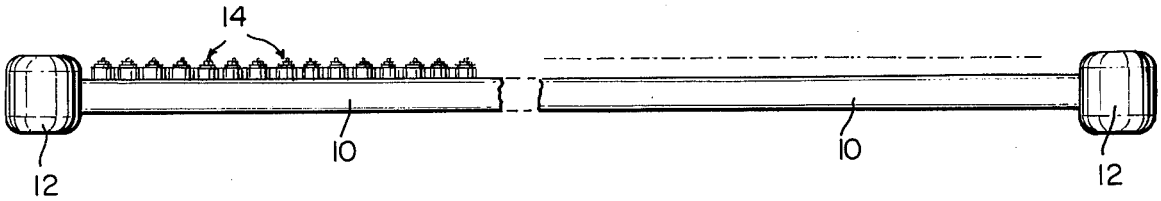
FIG. 2
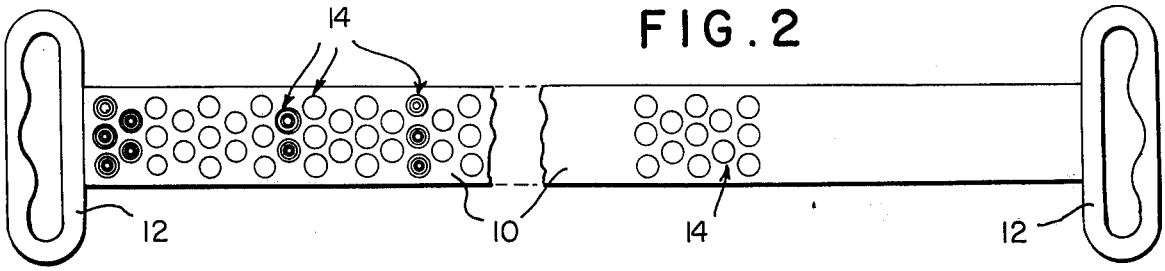
FIG. 3
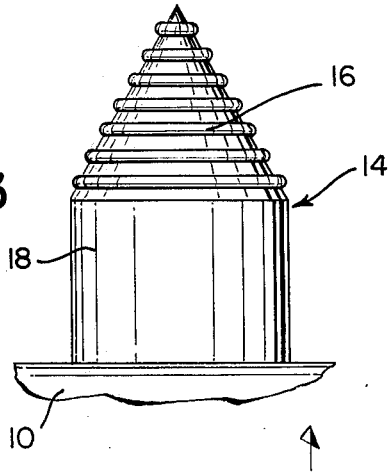
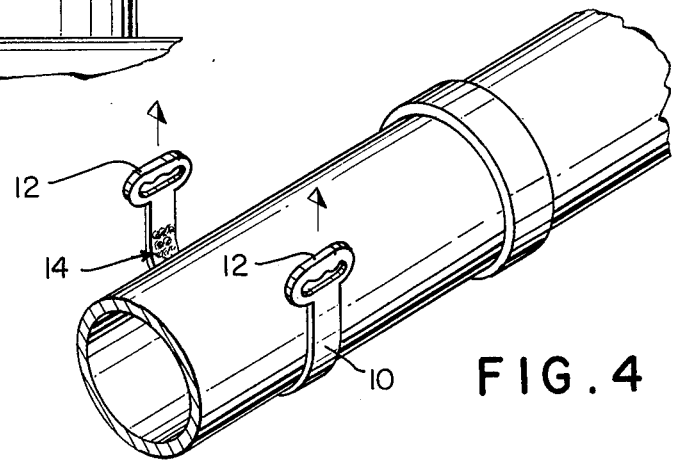
FIG. 4

FLEXIBLE STRAP WRENCH

BACKGROUND OF THE INVENTION

This invention relates to a flexible strap wrench. More particularly, the invention relates to a strap having a plurality of friction ribs on at least one surface thereof that are adapted to firmly engage the workpiece.

In the joining of one length of threaded pipe to another, an extreme amount of torque is needed in that constant turning is required to complete engagement. This situation can be quite awkward and cumbersome when working below one's waist such as when stooped over in an area of relatively little maneuverability, i.e., a trench or the like. A similar situation prevails when one is forced to work over one's head with the arms raised upward.

The prior art discloses a variety of wrenches and flexible bands and the like, for example, U.S. Pat Nos.: 2,422,715; 2,458,393; 2,554,410; 2,656,749; 2,897,705; 2,995,965; 3,682,023; 3,728,916; and others. All of the foregoing designs, however, are more appropriately directed to tools for removing caps from jars or other spherical workpieces, i.e., oil filters and the like. They are not suited for working by both hands in a manner as aforedescribed. That is, where one merely places the strap under or over the pipe, depending upon the location thereof and works the pipe by a spinning motion effected thereon by the actions of the wrists of each hand, one hand briskly pulling upward on the strap while the other briskly pulls downward. The pipe is thereby spun and the threaded connection made.

In like manner, the invention is also applicable for the removal of caps and the like.

SUMMARY OF THE INVENTION

It is accordingly an object of the instant invention to avoid one or more drawbacks of the prior art.

It is another object of the invention to provide for an improved strap wrench.

It is a further object of the invention to provide for the above at relatively little cost thereby making the same generally available to the public.

These and other objects of the invention will become more apparent from the following detailed disclosure and claims and by reference to the accompanying drawings, in which:

FIG. 1 is a side elevational view of the strap wrench;

FIG. 2 is a top plan view thereof;

FIG. 3 is an enlarged view of the ribs as shown on the strap in FIG. 1; and FIG. 4 is a view showing the strap on the workpiece.

Broadly speaking, the invention includes the provision of a flexible strap wrench comprising an elongated substantially rectangularly shaped strip of material, the material having two distal end portions and at least two surfaces, a plurality of raised ribs dispersed substantially about at least one surface of the material adapted to frictionally engage a workpiece.

DETAILED DISCLOSURE

Referring more particularly to the drawings, there is shown an elongated substantially rectangular strip 10 of a flexible material such as natural or synthetic rubber. The strip or strap 10 is preferably about 2 to 3 feet in length and ½ to 1 inch in width, and about one-eighth to one-half in thickness. The strap 10 will include two distal end portions that preferably define looped end portions or handles 12, i.e., finger receiving apertures, that are adapted to receive at least some of the fingers of the hands therethrough. The entire strap 10 with the looped end portions 12 is preferably unitary, though the latter may suitably be affixed thereto. At least one surface of the strap 10 will define a plurality of raised ribs 14 that may be randomly or uniformally dispersed substantially thereover. They may be unitary therewith or affixed thereto. The other surface of the strap 10 can, if desired, also contain the ribs 14. The ribs 14 will preferably be cone shaped at the top portion thereof 16 and substantially spherical at the bottom portion 18 thereof. Alternatively, a plurality of elongated ribs 14 running transverse the longitudinal axis of the strap 10 may also be employed as may other suitably shaped ribs or gripping teeth.

Since it is obvious that numerous changes and modifications can be made in the above-described details without departing from the spirit and nature of the invention, it is to be understood that all such changes and modifications are included within the scope of the invention.

I claim:

1. A flexible strap wrench comprising an elongated substantially rectangularly shaped strip of material, said material having two distal end portions having handle means unitary therewith and at least two surfaces, a plurality of raised ribs dispersed substantially about at least one surface of said material adapted to frictionally engage a workpiece, each of said ribs being cone shaped and including a plurality of annular rings therearound.

2. The wrench as defined in claim 1 wherein said handle means are looped end portions adapted to receive the fingers of the operator and are enlarged relative to the width of said material.

3. The wrench as defined in claim 2 wherein said looped end portions are unitary with said material.

4. The wrench as defined in claim 1 wherein said ribs are randomly dispersed.

5. The wrench as defined in claim 1 wherein said ribs are elongated teeth like structures disposed transverse the longitudinal axis of said material.

6. The wrench as defined in claim 1 wherein said ribs are uniformally dispersed.

7. The wrench as defined in claim 1 constructed of natural or synthetic rubber.

8. The wrench as defined in claim 1 wherein both surfaces contain said ribs.

* * * * *